United States Patent [19]

Philip et al.

[11] 4,036,640

[45] July 19, 1977

[54] ALLOY STEEL

[75] Inventors: Thoni V. Philip; Gunvant N. Maniar, both of Reading, Pa.

[73] Assignee: Carpenter Technology Corporation, Reading, Pa.

[21] Appl. No.: 757,250

[22] Filed: Jan. 6, 1977

[51] Int. Cl.[2] ..... C22C 38/22; C22C 38/24; C22C 38/26; C22C 38/30

[52] U.S. Cl. ..... 75/126 C; 75/124; 75/126 E; 75/126 F; 75/126 H; 148/36; 148/37

[58] Field of Search ..... 75/124, 126 H, 126 C, 75/126 E, 126 F; 148/37, 36

[56] References Cited

U.S. PATENT DOCUMENTS

| | | | |
|---|---|---|---|
| 3,012,879 | 12/1961 | Schempp et al. | 75/126 E |
| 3,833,360 | 9/1974 | Giflo et al. | 75/126 C |
| 3,918,928 | 11/1975 | Kiyonaga et al. | 75/126 E |
| 3,945,821 | 3/1976 | Stroup | 75/126 E |

*Primary Examiner*—Arthur J. Steiner
*Attorney, Agent, or Firm*—Edgar N. Jay

[57] ABSTRACT

An alloy steel is provided containing, by weight percent, carbon 0.5–1.1, manganese 0.10–<0.50, silicon 0.10–<0.80, chromium 3.5–5.0, molybdenum 2.5–5.0, vanadium 0.5–2.0, cobalt 0.5–4.0, columbium 0.15–0.50, up to 0.10 aluminum and the balance iron except for incidental impurities. The alloy can be balanced to provide a minimum room temperature hardness of $R_c$ 60 with outstanding toughness and ductility or to provide a minimum room temperature hardness of $R_c$ 63 with good wear resistance and toughness.

12 Claims, No Drawings

ALLOY STEEL

BACKGROUND OF THE INVENTION

This invention relates to an alloy steel characterized by an outstanding combination of strength and hardness and, more particularly, to such an alloy which is readily balanced to provide a unique combination of toughness, ductility and hardness.

Alloy steels have hitherto been provided which have had good toughness and ductility combined with high strength, but such alloys have left much to be desired. For example, in an effort to maximize secondary hardness, that is the hardening effect provided by the precipitation of fine carbides from the martensitic matrix during tempering, the parts fabricator is lead to use high austenitizing temperatures. While this may provide a higher degree of hardness, it also usually results in unacceptably coarse grain structures in the heat-treated part. The increasingly more general use of vacuum heat-treating furnaces is believed to have resulted in more frequent occurrence of this problem of excessive grain coarseness. This may be best illustrated by considering a well known alloy steel type A.I.S.I. M50 containing 0.80% carbon, 0.25% manganese, 0.25% silicon, 4.00% chromium, 1.00% vanadium, 4.50% molybdenum and the balance iron except for incidental impurities, used in the manufacture of bearings. If in order to maximize heattreated hardness and consistently attain a minimum room temperature hardness of $R_c$ 60 and a minimum hot hardness of $R_c$ 45 at 1000° F to enhance bearing life, bearing manufacturers exceed the permissible austenitizing temperature range of 2000° to 2050° F, an overheated coarse microstructure results which is brittle.

A similar problem has been encountered in connection with the fabrication of band saw blades from M50 alloy steel where at least the teeth forming portion of the blade must have high hardness and wear resistance. While a room temperature hardness of about $R_c$ 60–61 was attainable, it suffered from poor blade life believed to be caused by the presence of excessively large grains.

SUMMARY OF THE INVENTION

It is, therefore, a principal object of this invention to provide an improved alloy steel which can readily be balanced so as to provide a minimum as heat-treated room temperature hardness ranging from about $R_c$ 60 to $R_c$ 64, as desired, with good hot hardness and a fine grain structure after heat treatment, and having good wear resistance.

Significant advantages of the present invention are attained by balancing the alloy steel within the following broad range so as to provide a substantially martensitic microstructure, that is no more than about 10% retained austenite, in the heat treated and tempered condition:

| | w/o |
|---|---|
| Carbon | 0.5–1.1 |
| Manganese | 0.10–<0.50 |
| Silicon | 0.10–<0.80 |
| Chromium | 3.5–5.0 |
| Molybdenum | 2.5–5.0 |
| Vanadium | 0.5–2.0 |
| Cobalt | 0.5–4.0 |
| Columbium | 0.15–0.50 |
| Aluminum | up to 0.10 |

The balance of the composition is iron except for incidental impurities which may include up to about 0.025% sulfur, up to about 0.025% phosphorus, up to about 0.50% nickel, up to about 0.35% copper, up to about 0.15% tungsten, up to about 0.04% nitrogen, and up to about 0.15% titanium.

DESCRIPTION OF THE PREFERRED EMBODIMENTS

In the alloy steel of this invention, a minimum of 0.5% carbon is required in order to consistently attain the required minimum heat-treated hardness of $R_c$ 60. Here and throughout this application, by "heat-treated hardness" is intended material which has been austenitized, quenched and tempered. To provide the combination of a hardness of at least $R_c$ 60 with good toughness and ductility, no more than 0.70% carbon is used. Better yet, carbon should be limited to no more than about 0.65%, and, for best results in providing high hardness combined with good toughness, 0.53–0.60% carbon is preferred. On the other hand, when high hardness for good cutting performance and wear resistance are wanted as in band saw blade material. A minimum of 0.75% carbon is required, preferably 0.82–0.90%, to attain a minimum heat-treated hardness of $R_c$ 63 at room temperature with good wear resistance and yet tolerable toughness and ductility.

Manganese is a preferred deoxidizer that is used in the preparation of the alloy steel of this invention and, because some retained manganese contributes to the hardenability of this composition, a minimum of about 0.10% but less than 0.50%, preferably 0.15–0.45% is present to ensure complete deoxidation and the desired hardenability. Larger amounts of manganese are to be avoided because with too much manganese present, there may be excessive retained austenite, that is more than the tolerable 10%, in the fully heat-treated condition. When necessary to control the amount of retained austenite, the amount of manganese is limited to no more than 0.35% or even to no more than 0.25%. It is to be noted that the present composition is balanced within the stated ranges so as to provide a steel which is primarily martensitic, that is about 75–95% martensite in the austenitized and quenched condition and from 90 to almost 100% martensite after tempering.

Silicon is present in this composition in an amount of 0.10 to less than 0.80%. From about 0.10 to 0.40%, silicon functions primarily as a deoxidizer and, like manganese, contributes to the hardenability of the composition. For such purposes, 0.15 to 0.30% silicon is preferred. As the amount of silicon present is increased above about 0.30%, particularly with the larger amounts of cobalt, about 3–4%, contemplated herein, silicon increasingly functions as a hardening agent. To consistently attain hardness levels above $R_c$ 63, in material tempered at 1025° F, a minimum of 0.35%, preferably 0.40%, silicon is used. With silicon at about 0.35%, the minimum cobalt required for such high hardness levels is at least 2.75% and molybdenum should be at or above about 4.25%. As will be more fully pointed out hereinbelow, the silicon, cobalt and molybdenum contents are more precisely adjusted in accordance with the present invention to ensure a minimum heat treated hardness of $R_c$ 63. Excessive silicon tends to cause hot working difficulties such as forging cracks, decarburization and scaling. Therefore, silicon is kept below 0.80%, preferably to no more than 0.75%. For best results, silicon is present in an amount ranging from 0.5% to 0.6%. While silicon in amounts greater than 0.3% contributes to the hardness of the present composition, it does not contribute to secondary hardening in the absence of the required amounts of cobalt and molybdenum. When the three elements silicon, cobalt, and molybdenum are present, then silicon has a greater effect, weight-for-weight, on secondary hardness than the cobalt and molybdenum.

Chromium in an amount of about 3.5 to 5.0% primarily is used for its contribution to hardenability. Chromium also acts to retard softening during tempering. When present in amounts above 5%, chromium does not contribute enough improvement to warrant its cost, and when excessive amounts of chromium are used, particularly when carbon is near the lower end of its range, it could result in the presence of undesired ferrite. To ensure the desired degree of hardenability, a minimum of 3.75% chromium is preferably used, and to limit the cost of the composition, a maximum of 4.5% or, better yet, 4.25% is preferred.

Over the range of 0.5 to 2.0%, vanadium contributes secondary hardening, high hardness and wear resistance depending upon the amount present. Furthermore, when the amount of vanadium present is sufficient to ensure saturation of the austenite formed at the austenitizing temperature and no more in excess thereof than to form a minimum of vanadium carbides when the material is in the heat treated condition, the vanadium contributes significantly to secondary hardening while the material retains good toughness and ductility. For best toughness and ductility, carbon is not to exceed about 0.70%, silicon is not to exceed about 0.40%, molybdenum is not to exceed about 3.25%, and cobalt is not to exceed about 2.75%. To that end, vanadium is preferably limited to no more than 0.8% or, better yet, to no more than 0.7%, however, up to about 1.0% can be used. When the higher amounts of carbonj, silicon, molybdenum, and cobalt contemplated herein are used to provide a heat-treated hardness of $R_c$ 63 or more, vanadium can be present in an amount ranging up to 2.0% primarily for its beneficial effect on wear resistance; however, increasing vanadium detracts from toughness particularly above about 1.5%. While vanadium may contribute further wear resistance when present in an amount above 2.0%, the resulting increase in cost and reduction in toughness are not desirable. For best combination combination of hardness, wear resistance and toughness, 0.9 to 1.1% vanadium is preferred.

Molybdenum functions as a strong secondary hardening agent in this composition and, for this purpose, 2.5–5.0% molybdenum is used. As is well known, secondary hardening in alloy steels is a phenomenon associated with the precipitation of fine carbides from the martensitic matrix during tempering. Vanadium also forms such carbides. On the other hand, neither silicon nor cobalt themselves form carbides in the present composition; nevertheless, both silicon and cobalt cause enhanced secondary hardness by a mechanism which is not fully understood. To some extent, molybdenum and vanadium may provide some solid solution hardening by going into solution. The theory which seems most reasonable at this time is that by retarding the rate of diffusion of carbon out of solution, there mauy be a reduction in the rate of carbide nucleation and growth.

For a minimum heat-treated hardness of $R_c$60 at room temperature combined with good toughness and ductility, 2.5 to 3.25% molybdenum is preferred and, better yet, 2.7 to 3.1% but no more than will be taken into solution at the austenitizing temperature because, like vanadium, as the molybdenum content is increased above the amount which can be completely taken into solution at the austenitizing temperature, toughness and ductility suffer. When maximum hardness, hat is at least $R_c$ 63 at room temperature, is wanted, 3.5 to 5.0% molybdenum is preferred and best results can be attained with 4.0 to 4.5% molybdenum. Larger amounts than 5.0% molybdenum could be used in this composition, but above 5.0% the effect of molybdenum is too little to justify the added cost.

Cobalt in the range of 0.5 to 4.0%, primarily contributes to the heat treated room temperature and hot hardness of this composition. Because it detracts from the toughness and ductility of this composition when present in amounts greater than 2.75%, cobalt is preferably limited to that amount when good toughness and ductility, rather than maximum hardness, are wanted. Cobalt, like silicon but to a somewhat lesser extent, enhances the secondary hardness of this composition and also contributes to the level of hardness attained in the heat-treated condition. When carbon is below about 0.7%, then to ensure consistent attainment of the minimum hardness of $R_c$60, cobalt should not be less than 1.25%. For a best combination of properties, 1.5 to 2.5% cobalt is preferred for its effect on toughness and ductility and also for its effect on the hardness of the composition.

Columbium provides a unique effect in this composition by controlling and ensuring a fine grain size at the austenitizing temperature. The mechanism by which columbium acts to restrict grain growth even at such high austenitizing temperatures as 2150° F is not understood, but when at least 0.15% columbium is present, it ensures a maximum grain size, by Snyder-Graff intercept measurements, of 9. As much as 0.50% columbium can be used but, when too much columbium is used, it tends to tie up carbon to form unwanted carbides and deprive the matrix of that element. For most consistent results, 0.20 to 0.30% columbium is preferred or as much as 0.35% with the larger carbon contents.

When the product to be fabricated from the composition of this invention requires welding, as for example in the case of composite saw blades having a teeth-forming portion formed of this composition and a backing formed of another which are welded together, then 0.04 to 0.10% aluminum is included for its beneficial effect on the weldability of the composition.

Over the broad range of the present composition, a minimum hardness of $R_c$ 60 is readily attained. The following relationship can be used in balancing the present composition so as to consistently attain a minimum heat-treated hardness of $R_c$ 63:

$$1 \times \%Co + 13.3 \times \%Si + 2.05 \times \%Mo \nless 16$$

That is to say, the amount of cobalt in weight percent plus the weight percent silicon multiplied by 13.3 plus the weight percent molybdenum multiplied by 2.05 must not be less than 16. This relationship is valid for practical purposes when the silicon content is at least 0.35% and the molybdenum content ranges from 3.5–5.0%. This relationship is useful when balancing this composition to provide cutting tools combining high hardness and wear resistance with relatively low cost. A preferred composition for such products, except for incidental impurities, contains 0.82–0.90% carbon nominally 0.85%, 0.15–0.35% manganese nominally 0.25%, 0.5–0.6% silicon nominally 0.55%, 3.75–4.5% chromium nominally 4.0%, 4.0–4.5% molybdenum nominally 4.25%, 0.9–1.1% vanadium nominally 1.0%, 1.5–2.5% cobalt nominally 2.0%, 0.20–0.35% columbium nominally 0.25%, 0.04–0.1% aluminum nominally 0.06%, and the balance essentially iron.

On the other hand, when, as in the case of hot and cold work dies, e.g. thread rolling dies, or bearings or in material suitable for fabricating bearings to provide a minimum hardness of $R_c$ 60 combined with outstanding toughness and ductility, a preferred composition contains 0.53–0.60% carbon nominally 0.55%, 0.15–0.35% manganese nominally 0.25%, 0.15–0.30% silicon nominally 0.25%, 3.75–4.5% chromium nominally 4.0%, 2.70–3.10% molybdenum nominally 3.0%, 0.7–0.8% vanadium nominally 0.75%, 1.5–2.5% cobalt nominally 2.0%, 0.20–0.30% columbium nominally 0.25% and the balance iron except for incidental impurities. It is to be noted that the alloy of the present invention not only provides a room temperature minimum hardness of $R_c$ 60 but also a minimum ultimate tensile strength of 350 ksi with an elongation of at least 3% and a reduction in area of at least 5%. Combined with this ductility is an Izod (unnotched) toughness of at least 50 ft-lb when the composition is balanced so as to contain 0.5–0.70% carbon, 0.10–<0.50% manganese, 0.10–0.40% silicon, 3.5–5.0% chromium, 2.50–3.25% molybdenum, 0.5–1.0% vanadium, 1.25–2.75% cobalt, 0.15–0.50% columbium, up to 0.10% aluminum and the balance iron except for incidental impurities.

The alloy steel of the present invention is readily melted and cast as ingots and then shaped and worked using conventional melting techniques. Forging is carried out from a maximum furnace temperature of about 2100° F (about 1150° C), preferably 2050° F (1120° C). The material is annealed at a temperature of about 1550°–1650° F (845°–900° C) and austenitized at temperatures up to about 2150° F (about 1175° C), higher austenitizing temperatures tending to cause grain coarsening. Preferably, austenitizing is carried out at about 2100° F (about 1150° C), it also being necessary to avoid too low an austenitizing temperature to get the full secondary hardening effect. The material is preferably oil quenched and then tempered at about 975° F (about 525° C) or higher depending upon the desired hardness. With the higher alloying additions contemplated herein, a tempering temperature of at least about 1015° F (about 550° C) is peferred to ensure complete decomposition of austenite.

The following examples of the present invention were prepared as experimental 17 lb vacuum induction heats and cast into ingots having the composition, in weight percent, indicated in Table I.

TABLE I

| | Ex. 1 | Ex. 2 | Ex. 3 |
|---|---|---|---|
| C | 0.55 | 0.83 | 0.87 |
| Mn | 0.21 | 0.26 | 0.24 |
| Si | 0.17 | 0.46 | 0.62 |
| Cr | 4.01 | 3.93 | 3.96 |
| Mo | 2.99 | 4.24 | 4.24 |
| V | 0.76 | 1.02 | 1.01 |
| Co | 2.02 | 1.99 | 2.90 |
| Cb | 0.24 | 0.32 | 0.32 |
| Al | 0.05 | — | — |

In each case, the balance was iron except for incidental impurities. The ingots were forged from a furnace temperature of 2050° F (1120° C), reheating when necessary, to bars suitable for forming test specimens. Annealing was carried out by heating at 1550° F (843° C) for 4 hours, then cooling at the rate of 20° F/hr (7° C/hr) to 1100° F (593° C) followed by cooling in air. Austenitizing was carried out at 2080° F (1138° C) for Example 1, 2150° F (1177° C) for Example 2 and 2100° F (1149° C) for Example 3. Each was held at heat in salt for 5 minutes then quenched in oil. The specimens of Example 1 were tempered by heating at 1000° F (538° C) for 2 hours, cooling in air and then heating at 975° F (524° C) for 2 hours followed by cooling in air. The specimens of Examples 2 and 3 were tempered by heating at 1025° F (552° C) for two 2-hour periods each followed by cooling in air. The results of hardness measurements and Snyder-Graff intercept grain size determinations are indicated in Table II.

TABLE II

| | Annealed Hardness ($R_b$) | As Quenched Hardness ($R_c$) | Snyder-Graff Grain Size | Tempered Hardness |
|---|---|---|---|---|
| Ex. 1 | 88 | 63 | 11.2 | 59.7 |
| Ex. 2 | — | 62 | 11.1 | 64 |
| Ex. 3 | 96 | — | 13.3 | 64 |

The hardness measurements are the averages of 5 tests. In the case of the tempered hardness of Example 1, it is to be noted that the specimens had been austenitized at 2080° F (1138° C), but, if they had been austenitized at 2125° F (1163° C), the measured hardness would have been $R_c$ 60 or greater with a Snyder-Graff grain size of at least 9. Furthermore, because of unavoidable experimental error, a hardness of $R_c$ 59.7 is not significantly different from $R_c$ 60.

Standard room temperature tensile specimens of Example 1 were tested and gave an ultimate tensile strength of 361 ksi, with an average elongation (2 tests) of 4.7% and an average (2 tests) reduction in area of 12.3%. Toughness as measured by 3 unnotched Izod specimens of Example 1 gave an average of 75 ft-lb. Elevated temperature hardness of specimens of Example 1 was also measured and was found to be $R_c$ 52.8 at 900° F (482° C), $R_c$ 50 at 1000° F (538° C) and $R_c$ 47.5 at 1100° F (593° C).

The terms and expressions which have been employed are used as terms of description and not of limitation, and there is no intention in the use of such terms and expressions of excluding any equivalents of the featutres shown and described or portions thereof, but it is recognized that various modifications are possible within the scope of the invention claimed.

What is claimed is:

1. An alloy steel, which is hardenable by heating up to about 2150° F while retaining a Snyder-Graff grain size of 9 or finer and tempered to a room temperature hardness of at least about $R_c$ 60, which in its heat treated condition is substantially free of retained austenite, which by weight consists essentially of about

| | w/o |
|---|---|
| Carbon | 0.5–1.1 |
| Manganese | 0.10–<0.50 |
| Silicon | 0.10–<0.80 |
| Chromium | 3.5–5.0 |
| Molybdenum | 2.5–5.0 |
| Vanadium | 0.5–2.0 |
| Cobalt | 0.5–4.0 |
| Columbium | 0.15–0.50 |
| Aluminum | up to 0.10 |

and the balance essentially iron and incidental impurities.

2. The alloy steel set forth in claim 1 containing up to about 0.70% carbon and at least about 1.25% cobalt.

3. The alloy steel set forth in claim 2 containing 0.10–0.40% silicon.

4. The alloy steel set forth in claim 3 containing 0.5–1.0% vanadium.

5. The alloy steel set forth in claim 3 containing 3.5–5.0% chromium.

6. The alloy steel set forth in claim 1 containing about

| | w/o |
|---|---|
| Carbon | 0.5 - 0.70 |
| Manganese | 0.15 - 0.30 |
| Silicon | 0.10 - 0.40 |
| Chromium | 3.5 - 5.0 |
| Molybdenum | 2.50 - 3.25 |
| Vanadium | 0.5 - 0.8 |
| Cobalt | 1.25 - 2.75 |
| Columbium | 0.15 - 0.50 |

said alloy steel having an ultimate tensile strength of at least about 350 ksi with a minimum elongation of 3% in a gage length equal to 4 times its diameter and a minimum reduction in area of 5%, and having a minimum unnotched Izod toughness of 50 ft-lb.

7. The alloy steel set forth in claim 6 containing about

| | w/o |
|---|---|
| Carbon | 0.53 - 0.60 |
| Chromium | 3.75 - 4.5 |
| Molybdenum | 2.70 - 3.10 |
| Vanadium | 0.7 - 0.8 |
| Cobalt | 1.5 - 2.5 |
| Columbium | 0.20 - 0.30 |

8. The alloy steel set forth in claim 1 containing at least about 0.75% carbon, at least about 0.35% silicon, and at least about 0.7% vanadium.

9. The alloy steel set forth in claim 8 containing at least about 3.5% molybdenum.

10. The alloy steel set forth in claim 1 containing about

| | w/o |
|---|---|
| Carbon | 0.75 - 1.1 |
| Manganese | 0.10 - <0.50 |
| Silicon | 0.35 - 0.75 |
| Chromium | 3.5 - 5.0 |
| Molybdenum | 3.5 - 5.0 |
| Vanadium | 0.7 - 2.0 |
| Cobalt | 0.5 - 4.0 |
| Columbium | 0.15 - 0.50 |

said alloy steel being balanced so as to have a room temperature hardness of at least about $R_c$ 63.

11. The alloy steel set forth in claim 9 containing about

| | w/o |
|---|---|
| Carbon | 0.82 - 0.90 |
| Manganese | 0.15 - 0.35 |
| Silicon | 0.5 - 0.6 |
| Chromium | 3.75 - 4.5 |
| Molybdenum | 4.0 - 4.5 |
| Vanadium | 0.9 - 1.1 |
| Cobalt | 1.5 - 2.5 |
| Columbium | 0.20 - 0.35 |

said alloy steel having a room temperature heat-treated hardness of at least about $R_c$ 63.

12. The alloy steel set forth in claim 1 containing about

| | w/o |
|---|---|
| Carbon | 0.75 - 1.10 |
| Manganese | 0.10 - <0.50 |
| Silicon | 0.35 - <0.80 |
| Chromium | 3.5 - 5.0 |
| Molybdenum | 3.5 - 5.0 |
| Vanadium | 0.7 - 2.0 |
| Cobalt | 0.5 - 4.0 |
| Columbium | 0.15 - 0.50 |

in which the elements cobalt, silicon and molybdenum are balanced to satisfy the relationship $$1 \times \%Co + 13.3 \times \%Si + 2.05 \times \%Mo \nless 16$$

and has a heat-treated room temperature hardness of at least $R_c$ 63.

* * * * *